United States Patent [19]

English

[11] 4,438,906

[45] Mar. 27, 1984

[54] FORMERS FOR LINING METALLURGICAL VESSELS

[75] Inventor: Gary F. English, Conneaut, Ohio

[73] Assignee: Foseco International Limited, Birmingham, England

[21] Appl. No.: 505,818

[22] Filed: Jun. 20, 1983

[51] Int. Cl.[3] ..... C21B 7/04

[52] U.S. Cl. ..... 266/44; 266/281; 264/30

[58] Field of Search ..... 266/280, 281, 44; 264/30; 249/134

[56] References Cited

U.S. PATENT DOCUMENTS

| | | | |
|---|---|---|---|
| 2,438,559 | 3/1948 | Hubbell | 266/280 |
| 2,866,250 | 12/1958 | Ford et al. | 249/134 |
| 3,748,806 | 7/1973 | Talandis | 249/134 |

FOREIGN PATENT DOCUMENTS

| | | | |
|---|---|---|---|
| 762896 | 12/1956 | United Kingdom | 266/281 |

*Primary Examiner*—L. Dewayne Rutledge
*Assistant Examiner*—S. Kastler
*Attorney, Agent, or Firm*—Cushman, Darby & Cushman

[57] ABSTRACT

A hollow, disposable former for use in forming a lining in a metallurgical vessel e.g. a ladle for holding molten metal comprises a plurality of connected adjacent wall portions of drywall having dimensions and configurations to provide an outer surface which corresponds to the desired inner surface of the lining to be formed. Preheating the vessel prior to its use for containing molten metal decomposes and collapses the disposable former thus rendering removal of the former unncessary

16 Claims, 3 Drawing Figures

FORMERS FOR LINING METALLURGICAL VESSELS

The invention concerns formers for use in lining metallurgical vessels for containing molten metal and methods of lining such vessels.

The invention is of particular value in relation to steelworks ladles and foundry ladles, especially the latter. Such ladles are generally of bucket-like shape and have either an outlet e.g. a nozzle in the base or a lip over which molten is to be poured out of the ladle. The ladles usually have an outer metal shell and inside that a permanent lining of refractory brickwork or of rammed or cast refractory material forming a monolithic lining.

In the case of rammed or cast linings, a former has to be used to determine the thickness of the lining and the shape of its inner surface. The formers have usually been steel fabrications and these have been expensive to make. The known formers have tended to become damaged by repeated use and have then required repair or replacement.

One object behind the present invention was to provide a former, for use in lining a metallurgical vessel for containing molten metal, which would avoid disadvantages of known formers for this purpose. Another object was to provide an improved method of lining a metallurgical vessel for containing molten metal.

According to the invention there is provided a hollow, disposable former, for use in lining a metallurgical vessel for containing molten metal, comprising a plurality of connected adjoining wall portions of drywall sheet material sized and arranged to provide an outer surface corresponding to a desired inner surface of the lining to be formed.

'Drywall', otherwise known as plasterboard, is available in large sheets, e.g. more that 1000 mm wide and more than 2000 mm long, as a preformed material for use in providing a plaster layer for wall surfaces inside buildings. Drywall sheet material is available as a laminate in which an inner layer of plaster, usually about 10 mm thick, has bonded to each of the two faces a relatively thin layer of strong paper.

In accordance with the present invention it has been appreciated that use of drywall sheet material enables formers to be made that are both suitable for the purpose in question and disposable. In particular, although drywall sheet material is made for the very different purpose described above, it has now been realised that the material has properties of value for the purpose in question in the present invention. The material has a substantial degree of rigidity and formers of the invention can readily be made which permit the formation of linings having inner surfaces with shapes and dimensions matching those desired to a high degree of accuracy. Moreover, the material is of relatively low density and the disposable formers can be of relatively low weight, thus facilitating their handling. When a ladle, having a lining formed by use of a former of the invention and with the former still in position, is preheated the former decomposes and collapses; accordingly, removal of the former as such is unnecessary and time can therefore be saved and inconvenience reduced.

The use of the drywall sheet material enables the formers to be made economically and the fact that they are disposable—discarded after a single use—avoids any need for repair of used formers and for storage space for formers awaiting re-use or repair. Moreover, the formers can readily be made in a variety of shapes and sizes as required: drywall sheet material can be cut easily, and accurately, e.g. by sawing, into pieces of the required shapes and sizes for making the formers.

In the case of formers for use in lining ladles, the formers are preferably polygonal in cross-section. There is no need for the former to taper from top to bottom to facilitate stripping the former out of the ladle since, as indicated above, the former as such does not have to be removed from the ladle. In such a case the former, generally a hollow frustum may include a base portion in addition to the sidewall portions. The inclusion of a base portion increases the rigidity of the former and thus aids achieving and retaining the desired shape.

The sidewall portions are preferably separate pieces of drywall sheet material connected together, preferably by means of adhesive tape. For ease of transport and storage, the former may be supplied to the user in flat, partly assembled condition. Thus, a flat array of suitably connected adjoining sidewall pieces may be supplied and before use the two ends of the flat array brought together to form a hollow shape of polygonal section and the two ends connected e.g. by means of adhesive tape. If desired a separate base portion can then be secured to the hollow shape or, if the hollow shape tapers from top to bottom rather than is parallel sided a separate base portion slightly oversized in relation to the bottom of the hollow shape can be put inside the hollow shape and forced down to give a friction fit at or near the bottom of the hollow shape.

In accordance with the invention a method of lining a metallurgical vessel for containing molten metal comprises so positioning a former of the invention within the vessel as to leave a space between the former and the vessel corresponding to the lining to be formed, filling the space with hardenable refractory lining material, hardening the lining material, curing the lining material and discarding the former. Curing the lining material involves heating it to remove water and to complete the hardening process and in view of the high temperatures used for the latter purpose that stage of the method may be termed 'firing'.

It is usually desired for the lining of the base of a metallurgical vessel to have a substantially level upper surface and this can be achieved by use of rammable or castable refractory compositions without requiring the employment of a former. In view of this, it is usually preferred in accordance with the invention first to provide the base of the vessel with a hardenable refractory lining composition and, when this has at least partly hardened, to position the former in the vessel to rest on the lining on the base of the vessel and then form the lining of the vessel's sidewalls by use of the former. Accordingly, it is usually unnecessary for a former of the invention to have a base portion to determine the upper surface of the lining of the base of the vessel but a base portion may be used, as mentioned above, to increase the rigidity of the former or to minimise any risk of material supplied to form the sidewall lining escaping beneath the bottom of the former and into the cavity inside the former. For the purposes just mentioned the base portion used need not be of drywall sheet material but may be of, for example, cardboard.

If the former is to determine the upper surface of the lining of the base of the vessel as well as the inner surface of the sidewall lining, the former requires a base portion firmly secured to the rest of the former and preferably of drywall sheet material.

In the method of the invention the hardenable refractory lining material may be a castable or a rammable refractory composition. In the case of castable compositions, the material used may be self-setting and the initial hardening achieved simply by leaving the material to set. In the case of rammable materials, the initial hardening is effected by the ramming operation itself which may be effected by vibration. In either case, with the former still in place, the lining is heated to remove water and to achieve a chemical bond.

Castable refractory compositions generally contain a significant proportion of water and water may be lost from such compositions into the drywall of the former. In order to prevent or minimise this effect, the outer drywall surfaces of the former preferably have a water resistant layer e.g. provided by application of hot wax or other water resistant coating material or by application of a pre-formed water resistant film of, for example, plastics material.

In carrying out the method of the invention it is preferred to fill the interior of the former with particulate material e.g. sand before or during the filling of the space between the former and the vessel with the lining material. In the case of castable compositions, which are the preferred lining materials, the interior of the former is preferably filled with particulate material during the filling of the space between the former and the vessel and the two rates of filling preferably chosen such that the levels of the material inside and outside the former are approximately even throughout the filling operation. The use of the particulate material gives the former additional resistance to distortion caused by the lining material used.

The invention is of particular value in relation to ladles which are to have an inner, discardable lining of preformed heat-insulating boards in addition to the permanent lining. In such discardable linings the boards forming the sidewall lining are in a polygonal array and it is a substantial advantage for the interior of the permanent sidewall lining to have a closely matching configuration. Fabricated steel or similar formers suitable for forming such permanent linings are particularly expensive. Moreover, by virtue of the use of the inner, discardable lining, the permanent lining has a very long life and thus the expensive former is needed only infrequently and meanwhile takes up storage space. Accordingly, in such circumstances the disposable former of the invention is particularly advantageous.

The invention is further described with reference to the accompanying diagrammatic drawings in which.

Figure 1:
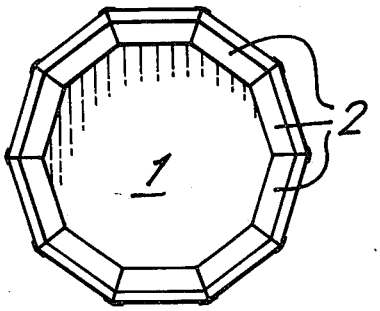
FIG. 1 is a top view of a former of the invention.
Figure 2:
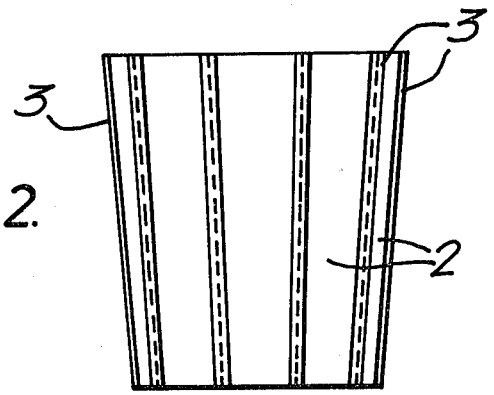
FIG. 2 is a side view of the former of FIG. 1.

Referring now to FIGS. 1 and 2, the former comprises a base portion 1 of laminated corrugated cardboard or drywall sheet material and ten downwardly tapering sidewall portions 2 of drywall sheet material together forming a hollow shape of decagonal cross-section. Each of the portions 2 is a separate member and has longitudinal edges shaped so that the edges of adjacent portions butt together as shown in FIG. 1. The adjoining portions 2 are connected together by means of strips of adhesive tape 3 covering longitudinal joins shown by the dotted lines in FIG. 2.

To form the assembly shown in FIGS. 1 and 2, the portions 2 are laid out inner face down with the longitudinal edges adjoining and the strips of adhesive tape 3 applied over each of the joints. The two free longitudinal edges are then brought together to form a hollow shape of decagonal cross-section and these longitudinal edges connected together by application of a further strip of the adhesive tape 3 over the joint. The base portion 1 is then put inside the hollow shape and forced into position where it is held by a friction fit and imparts rigidity to the former. If desired, additional means may be used for holding the portions 2 together e.g. one or more strips of adhesive tape may be fixed around the periphery of the former, for example, one strip near the top of the former and the other near the bottom of the former.

Figure 3:
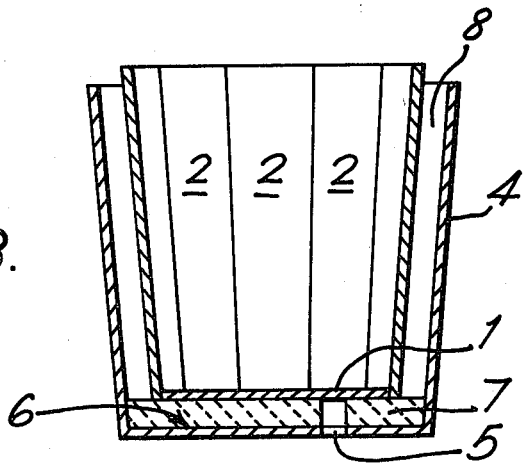
FIG. 3 is a vertical section through a bottom pour foundry ladle in which is positioned the former of FIGS. 1 and 2.
Figure 1:
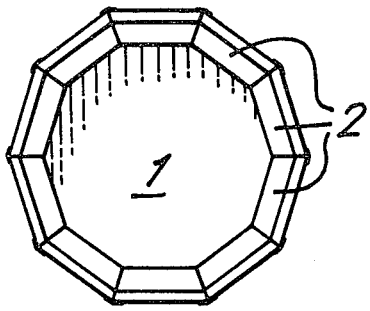
Figure 2:
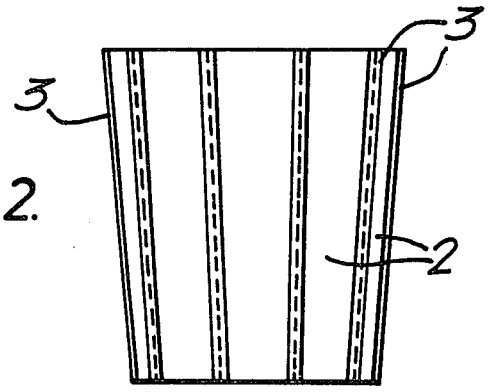
Figure 3:
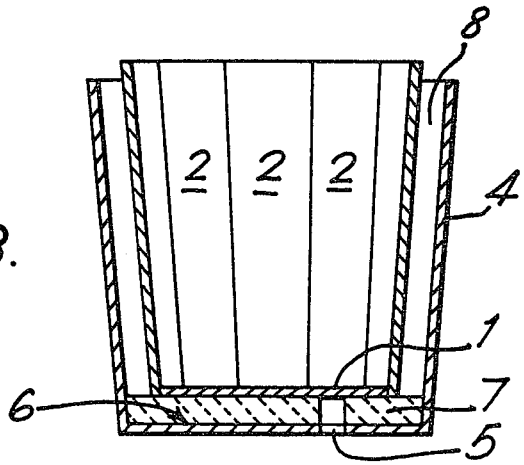

Referring now to FIG. 3, the ladle has an outer metal shell 4 having an aperture 5 for an outlet nozzle is base 6. The base 6 is provided with a permanent refractory lining 7 having an aperture aligned with the aperture 5 by use of a hardenable refractory lining material suitably a castable refractory composition. When the lining material has at least partially set, the former is correctly positioned in the ladle resting on the lining 7 as shown in FIG. 3, a generally annular space 8 remaining between the sides of the former and the ladle sidewall, this space corresponding to the desired form of the permanent lining of the ladle sidewall.

To form the permanent refractory lining for the ladle sidewall, hardenable refractory lining material, suitably castable refractory composition, is filled into the space 8 until that space is filled up to the top of the ladle shell 4. As the refractory lining material is filled into the space 8, dry sand may be filled into the hollow interior of the former to maintain a level of sand within the former similar to the level of the lining material in the space 8 and thereby resist deformation of the former.

Once the lining material in the space 8 is sufficiently hard, initial drying is effected followed by curing with the former still in position, the drying and curing being effected by heating.

Especially if the hardenable lining material used for the sidewall lining is a castable composition, the outer surfaces of the portions 2 of the former are advantageously given a water resistant layer e.g. by application of hot wax to prevent or minimise water in the lining material being lost into the drywall material.

I claim:

1. A method of lining a metallurgical vessel for containing molten metal, comprising the steps of:

(a) positioning within the vessel a hollow, disposable former comprising a plurality of connected adjoining wall portions of dry wall sheet material so as to leave a space between the former and the vessel corresponding to the lining of the vessel to be formed;

(b) filling the space with hardenable refractory lining material;

(c) while practicing step (b) filling the interior of the former with particulate material;

(d) hardening the lining material; and (e) drying and firing the lining to produce a metallurgical vessel lined with refractory lining material.

2. A method as recited in claim 1 wherein step (e) is practiced with the former in position, and comprising the further step of discarding the former after drying and firing.

3. A method as recited in claim 2 wherein steps (b) and (c) are practiced so that the particulate material and the refractory lining material are at similar levels so that deformation of the former is resisted.

4. A method as recited in claim 3 wherein the particulate material added in step (c) is dry sand.

5. A method as recited in claim 3 wherein the vessel is a ladle.

6. A method as recited in claim 3 wherein the lining material is a castable refractory composition.

7. A method as recited in claim 5 comprising the further steps of: initialling providing the base of the ladle with a refractory lining by utilizing a hardenable refractory lining material; and when the hardenable refractory lining material lining the base has at least partially hardened, practicing step (a) so that the former rests on the base lining.

8. A method as recited in claim 2 wherein the particulate material added in step (c) is dry sand.

9. A method as recited in claim 2 wherein the vessel is a ladle.

10. A method as recited in claim 9 comprising the further steps of: initialling providing the base of the ladle with a refractory lining by utilizing a hardenable refractory lining material; and when the hardenable refractory lining material lining the base has at least partially hardened, practicing step (a) so that the former rests on the base lining.

11. A method as recited in claim 2 wherein the lining material is a castable refractory composition.

12. A method as recited in claim 1 wherein the particulate material added in step (c) is dry sand.

13. A method as recited in claim 1 wherein the vessel is a ladle.

14. A method as recited in claim 13 comprising the further steps of: initialling providing the base of the ladle with a refractory lining by utilizing a hardenable refractory lining material; and when the hardenable refractory lining material lining the base has at least partially hardened, practicing step (a) so that the former rests on the base lining.

15. A method as recited in claim 1 wherein the lining material is a castable refractory composition.

16. A method as recited in claim 1 wherein steps (b) and (c) are practiced so that the particulate material and the refractory lining material are at similar levels so that deformation of the former is resisted.

* * * * *